US006663094B2

(12) United States Patent
Weissenborn

(10) Patent No.: US 6,663,094 B2
(45) Date of Patent: Dec. 16, 2003

(54) APPARATUS FOR HOLDING A SKI DURING REPAIR AND MAINTENANCE

(76) Inventor: Richard K. Weissenborn, 3017-6$^{th}$ St. S.W., Calgary, Alberta (CA), T2S 2M1

( * ) Notice: Subject to any disclaimer, the term of this patent is extended or adjusted under 35 U.S.C. 154(b) by 0 days.

(21) Appl. No.: 10/077,155

(22) Filed: Feb. 15, 2002

(65) Prior Publication Data

US 2002/0135117 A1 Sep. 26, 2002

(51) Int. Cl.$^{7}$ ..... B25B 1/20

(52) U.S. Cl. ..... 269/131; 269/88; 269/296; 269/906

(58) Field of Search ..... 269/4, 9, 10, 40, 269/43, 45, 275, 130, 131, 88, 296, 286, 906

(56) References Cited

U.S. PATENT DOCUMENTS

| | | | | |
|---|---|---|---|---|
| 1,928,892 A | * | 10/1933 | Hickey | 269/131 |
| 3,854,712 A | * | 12/1974 | McGee | 269/906 |
| 3,963,234 A | * | 6/1976 | Bejtlich | 269/906 |
| 3,977,663 A | * | 8/1976 | Kohler et al. | 269/906 |
| 4,081,180 A | * | 3/1978 | Munn | 269/906 |
| 4,615,073 A | * | 10/1986 | Haak | 269/131 |
| 5,150,887 A | | 9/1992 | Weissenborn et al. | |
| 6,305,679 B1 | * | 10/2001 | Brill | 269/906 |

FOREIGN PATENT DOCUMENTS

| | | |
|---|---|---|
| CA | 2189615 | 5/1997 |
| CA | 2030395 | 11/2000 |

* cited by examiner

*Primary Examiner*—Robert C. Watson
(74) *Attorney, Agent, or Firm*—Dinsmore & Shohl LLP

(57) ABSTRACT

Apparatus for holding a ski in a stable horizontal position during ski base preparation and maintenance, which apparatus also employs means permitting the ski to be placed in an edge-up orientation and held there in a stable manner for ski edge maintenance procedures. A three-point arrangement includes two ski end supports and an intermediate device which secures the ski to a work station while retracting and holding the ski brake. The apparatus is portable and adaptable for use with all skis having a ski brake.

1 Claim, 8 Drawing Sheets

APPARATUS FOR HOLDING A SKI DURING REPAIR AND MAINTENANCE

BACKGROUND OF THE INVENTION

This invention relates to an apparatus for holding a ski or the like in such manner as to facilitate waxing and maintenance operations thereon.

The prior art has provided various forms of devices for holding skis on or above a stationary support such as a workbench to allow for preparation of the ski base and edges. One such ski holding device is disclosed in U.S. Pat. No. 5,150,887 to Weissenborn et al issued Sep. 29, 1992.

Skis have become increasingly popular in recent years and require frequent maintenance to ensure optimal performance and prolonged useful life. Maintenance procedures include cleaning, repair and waxing of the ski base materials as well as maintenance of the ski edges to remove roughness and the like. These procedures must be repeated throughout the life of the ski and hence it is desirable to provide apparatus for securing the ski in positions such that maintenance work can readily be accomplished, with, at the same time, a minimum amount of time and effort being required to mount and dismount the ski to and from the ski holder.

SUMMARY OF THE INVENTION

It is a general object of the invention to provide an improved apparatus for holding skis and the like at a work station during repair and maintenance operations.

A further object is to provide apparatus for holding a ski in a stable horizontal "base-up" position during ski base preparation and maintenance, which apparatus also employs means permitting the ski to be placed in horizontal "edge-up" orientation and held there in a stable manner for ski edge maintenance procedures.

A further object is to provide apparatus of the nature noted above which incorporates means by which to retract the ski brake so that said ski brake does not interfere with ski base and edge preparation and maintenance procedures.

It is a further object of the invention to provide an improved three-point ski-holding arrangement where two end supports provide substantial support of the ski for ski base and edge preparation and wherein an intermediate tensioning device retracts the ski brake and firmly holds the ski to said end supports under tension with the ski either base-up and parallel, or on its side with the ski base perpendicular to the top surface of a work station.

It is a further general object to provide apparatus for use in ski maintenance and repair procedures which is adaptable for use with a wide variety of skis with bindings.

Accordingly, the invention in one embodiment provides a portable support for use in spaced relation with a similar support as a ski support for maintenance operations at a work station, each said support being adapted to support one of the opposing end portions of the ski. Each portable support typically comprises a base section adapted to be fixed to a work station in a generally upright position and a ski support head mounted to said base section allowing placement of the ski in a desired position to facilitate maintenance procedures.

The ski support head typically has a resilient surface thereon to frictionally engage the ski when resting thereon in a generally horizontal ski base maintenance position or, alternatively, the ski edge maintenance position.

A typical embodiment of the invention provides a tensioning device comprising a clamp associated with a length of rope or accessory cord and a cleat and which tensioning device is adapted to be attached to the work station intermediate a pair of said supports to provide means by which to engage and retract the ski brake and thereby hold the ski against said supports during ski base and edge maintenance.

Further features of the invention will be apparent from the detailed description of preferred embodiments which follows hereinafter, reference being had to the appended drawings.

BRIEF DESCRIPTION OF VIEWS OF DRAWINGS

DETAILED DESCRIPTION OF THE PREFERRED EMBODIMENTS

Referring to FIGS. 1–12, which illustrate an embodiment of the invention there is shown a pair of portable supports 10 for use in spaced relation with one another as a ski support for maintenance operations being carried out at a work station. Each of these supports is adapted to support one of the opposing end portions of the ski 12.

Figure 1:
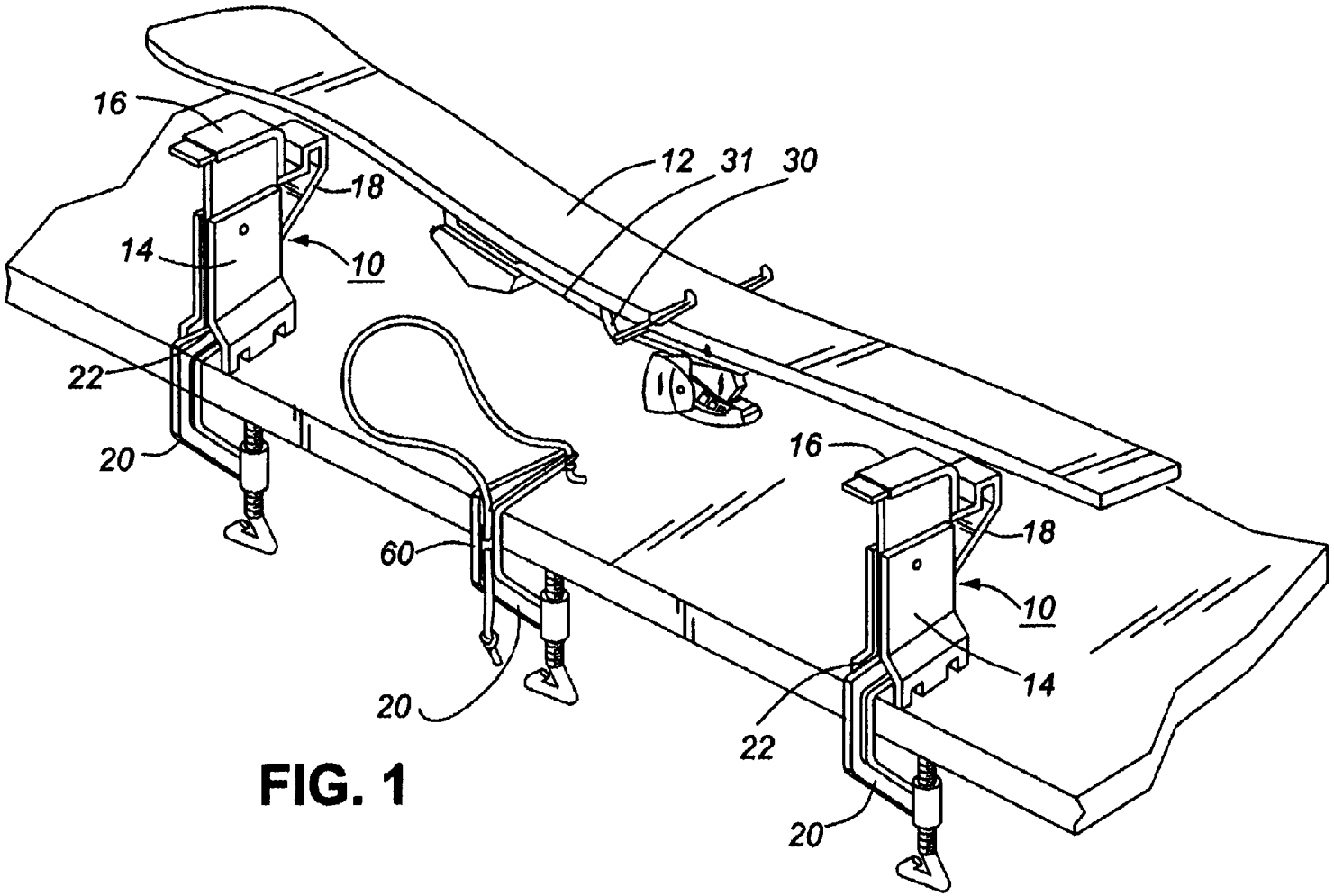
FIG. 1 is a perspective view showing a spaced pair of ski supports for supporting opposing end potions of the ski and a tensioning device intermediate thereof, all of the above being shown as clamped to a table or work station and illustrating a ski with binding shown in a raised position above the apparatus.
Figure 2:
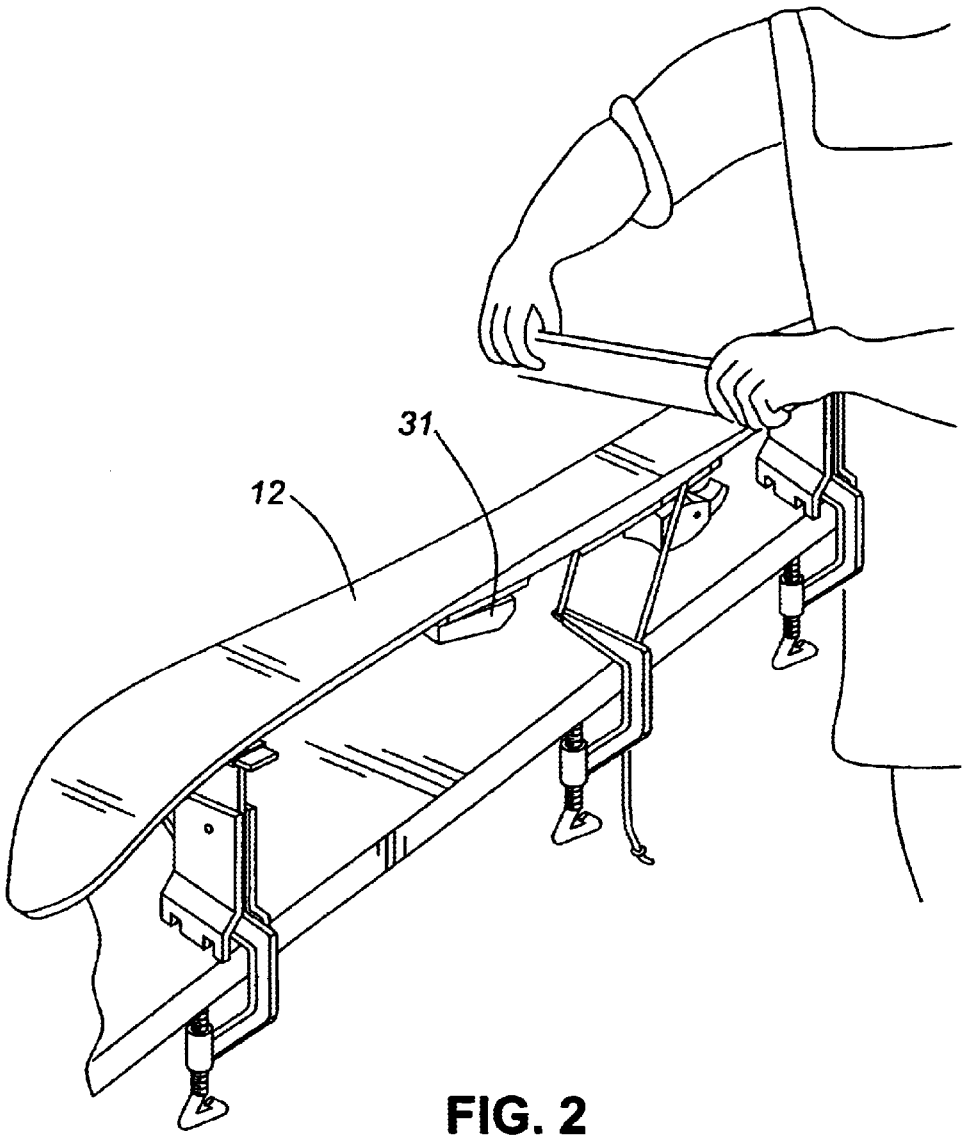
FIG. 2 is a further perspective view showing the ski positioned on the two supports with the tensioning device employed to facilitate ski base preparation/maintenance.
Figure 7:
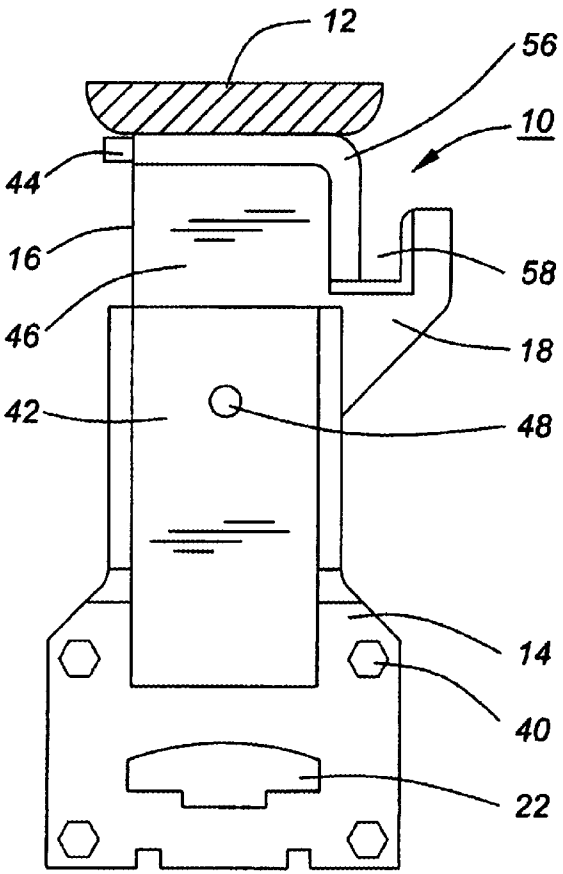
FIG. 7 is an elevation view, partly in section, of the ski positioned horizontally on the ski support to facilitate ski base preparation.
Figure 8:
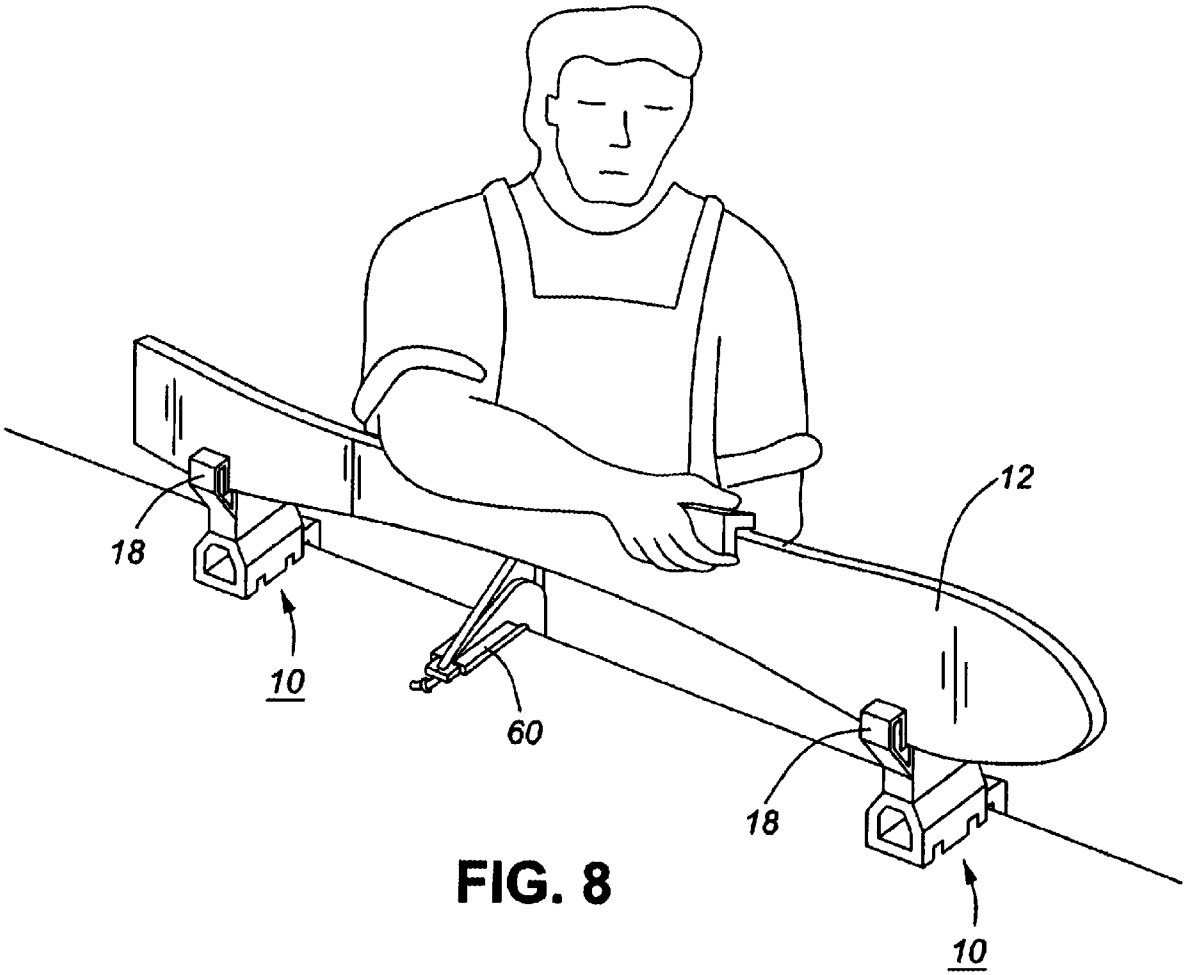
FIG. 8 is a further perspective view showing the two ski supports and tensioning device clamped to a work station with the ski having been moved into an "edge-up" position and held by the tensioning device against the supports for ski edge maintenance.
Figure 9:
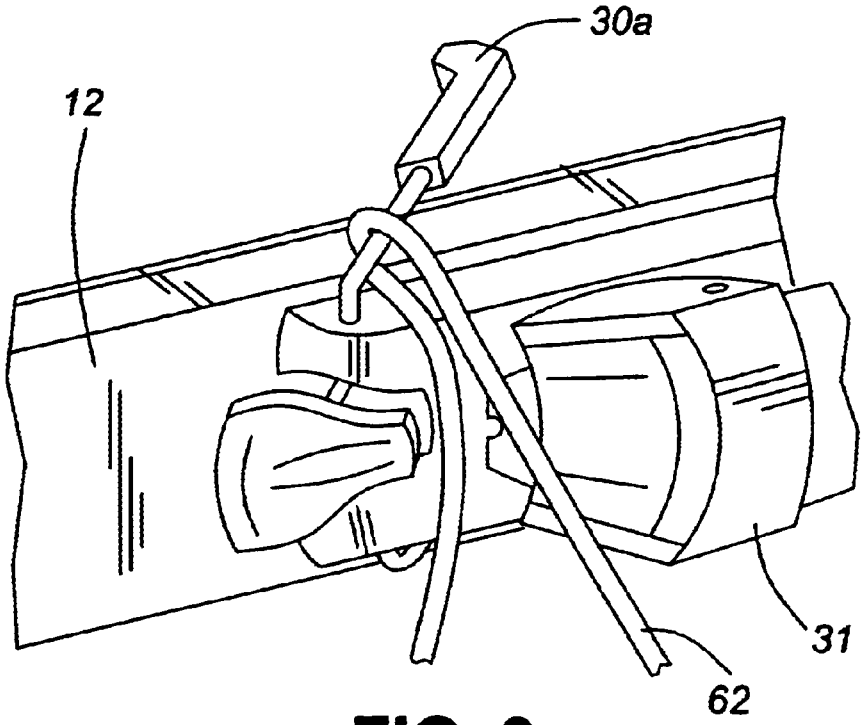
FIG. 9 is a view similar to that of FIG. 4 except that the ski is positioned "edge-up"
Figure 10:
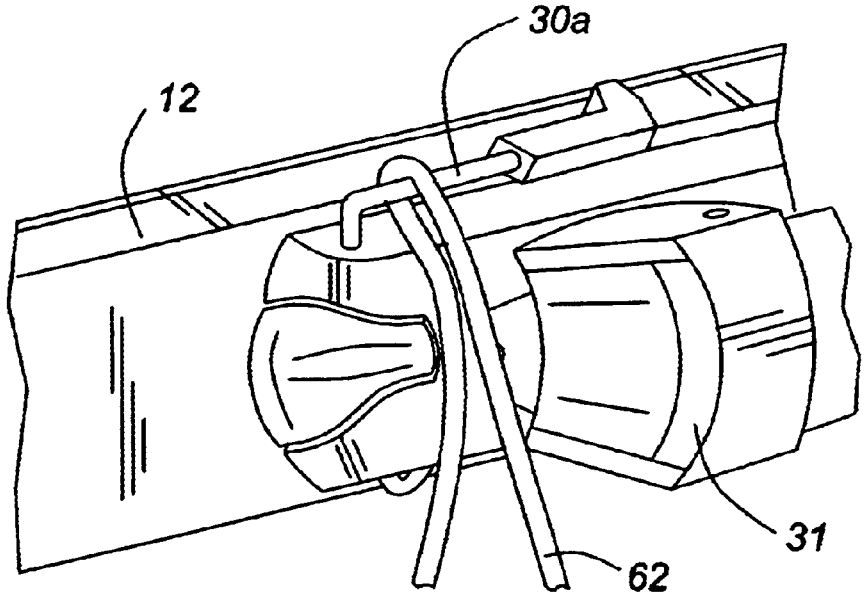
FIG. 10 is a view similar to that of FIG. 5 except that the ski is positioned "edge-up" to facilitate ski edge preparation.
Figure 12:
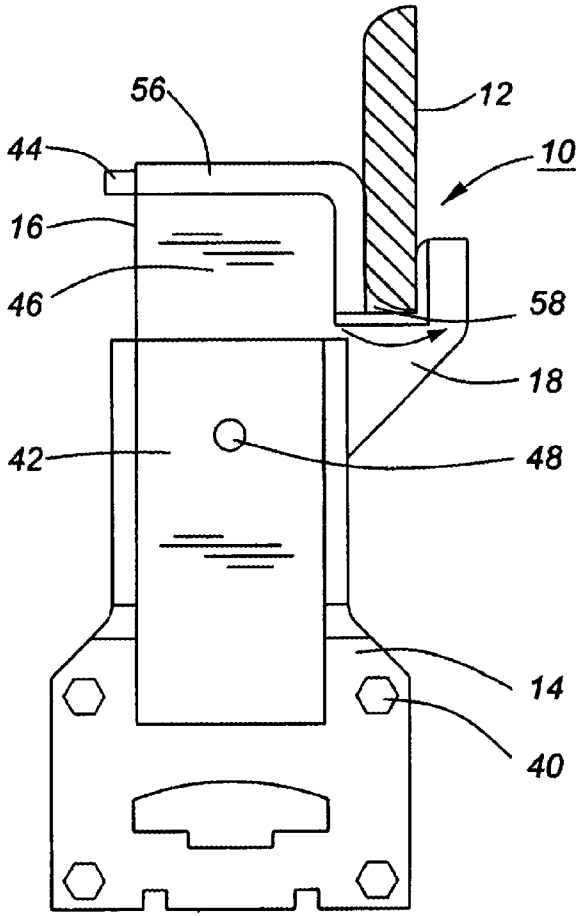
FIG. 12 is a view similar to that of FIG. 7 except that the ski is positioned vertically to facilitate ski edge preparation.

Essentially, each support comprises a base section 14 adapted to be fixed to the work station in a generally upright position. A ski support head 16 is mounted to the base section 14 to facilitate ski base maintenance (as seen in FIGS. 1, 2 and 7). It will also be seen that the ski support heads 16 each further include a side holder 18 thereon for holding the ski in a generally "edge-up" orientation for ski edge maintenance (as seen in FIGS. 8 and 12). By virtue of this mounted support head 16 and side holder 18 arrangement, the supports 10 facilitate both ski base maintenance and ski edge maintenance operations. Further details of the holder configuration and construction will be described hereinafter.

As clearly seen in FIGS. 1 and 2, the supports 10 are mounted to the work station by means of C-clamps 20. The base sections 14 of the holders are provided with convenient apertures 22 extending above and parallel to the base bottoms thereby to receive the upper legs of the C-clamps 20 to permit convenient clamping to the work station.

Reference will now be had to FIGS. 7 and 12 which show the supports in detail. Each support 10 is preferably made from a sturdy moulded plastics material preferably reinforced with glass fibers to provide the necessary strength and rigidity. The base section 14 is preferably moulded as two halves being held together by threaded fasteners 40. These two halves of the base section, when assembled together, also interlock with and securely fix the support head 16 to the base section 14.

The upper half of the base section 14 includes a spaced apart generally parallel pair of wide but relatively thin flanges 42. The previously mentioned support head includes a head portion 44, to the central portion of which is affixed a support tongue 46. This support tongue 46 is generally rectangular in shape and sized so as to fit between the two flanges 42 noted above so that tongue 46 is sandwiched between flanges 42. The flanges 42 and support tongue 46 have an aperture 48 that allows a threaded fastener to pass through the support tongue 46 and flanges 42 thereby providing means to secure support head 16 firmly to base section 14 and preventing any unwanted movement between base section 14 and support head 16.

The head portion 44 of the support head 16 is provided with a resilient rubber pad 56 that wraps around one side of the flanges 42 of the base section to prevent damage to the ski 12 upper surface during use and also provide for good frictional engagement therewith. The support head 16 is also provided with reinforcing flanges disposed in flanking relation to the support tongue 46 to provide the desired rigidity.

With reference to FIGS. 7 and 12 for example, the side holder 18 is an integral part of the support tongue 46 portion of support head 16 and is moulded as a one-piece formation providing a recess 58 for holding a ski in the "edge-up" position. As illustrated in FIG. 12 the side holder 18 allows the ski to be positioned in a generally edge-up orientation in recess 58 between rubber pad 56 and the inside walls of the holder 18.

Figure 3:
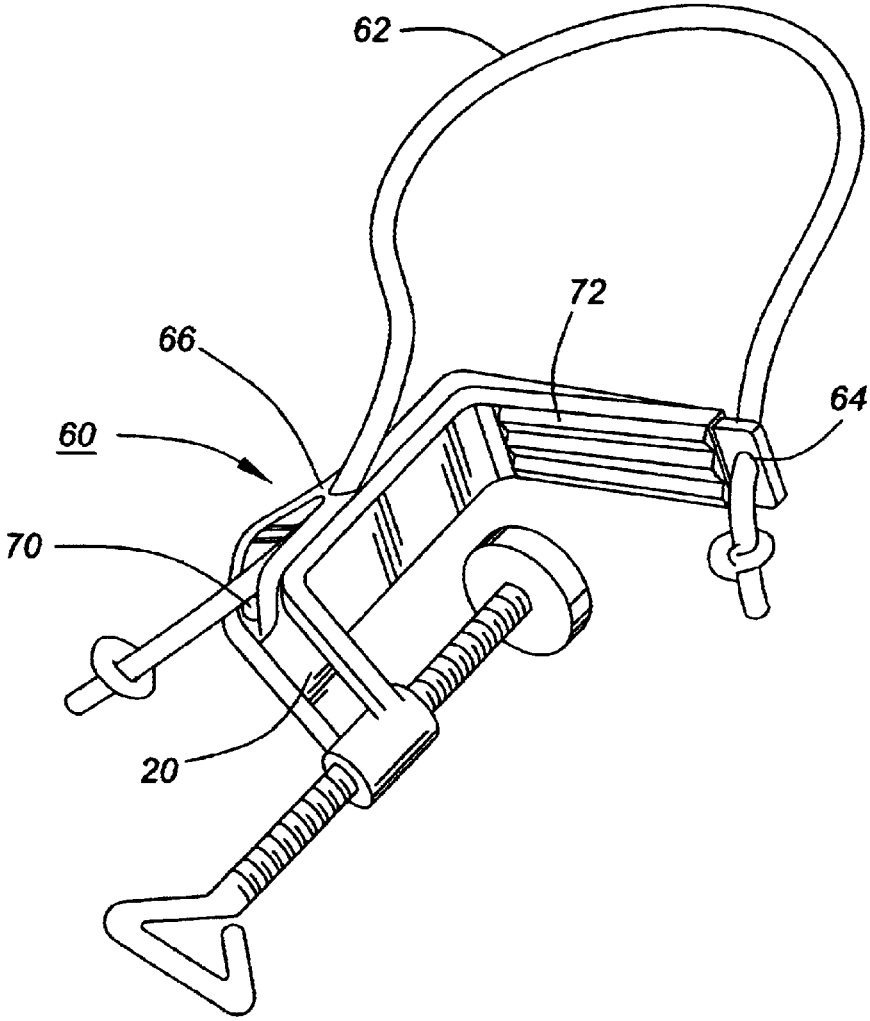
FIG. 3 is a further perspective view of the tensioning device assembly showing the C-clamp, accessory cord and cleat components thereof.
Figure 4:
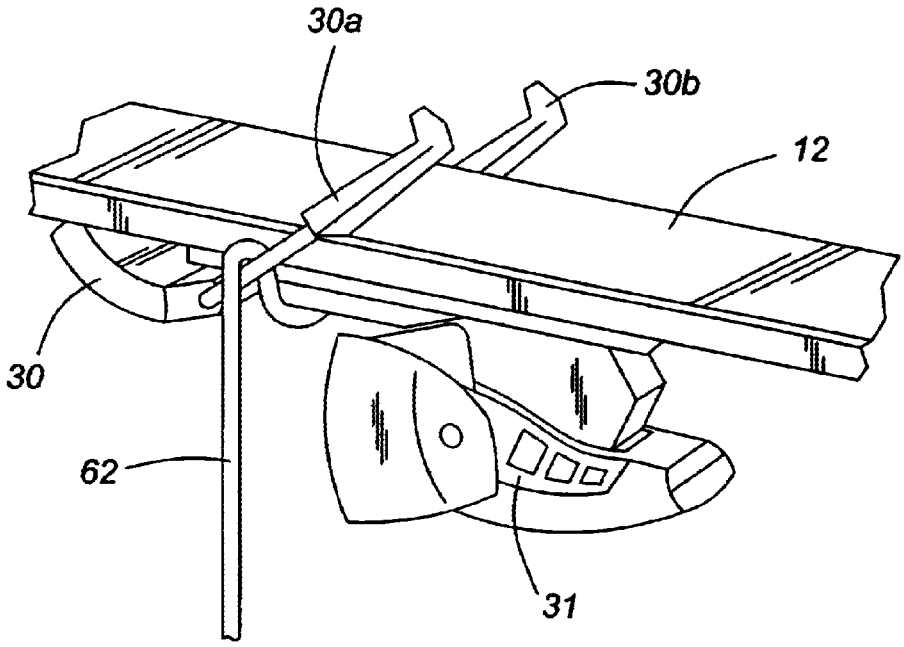
FIG. 4 is a further perspective view of the ski in a horizontal position with the accessory cord relaxed and looped around the ski brake portion of the ski binding.
Figure 5:
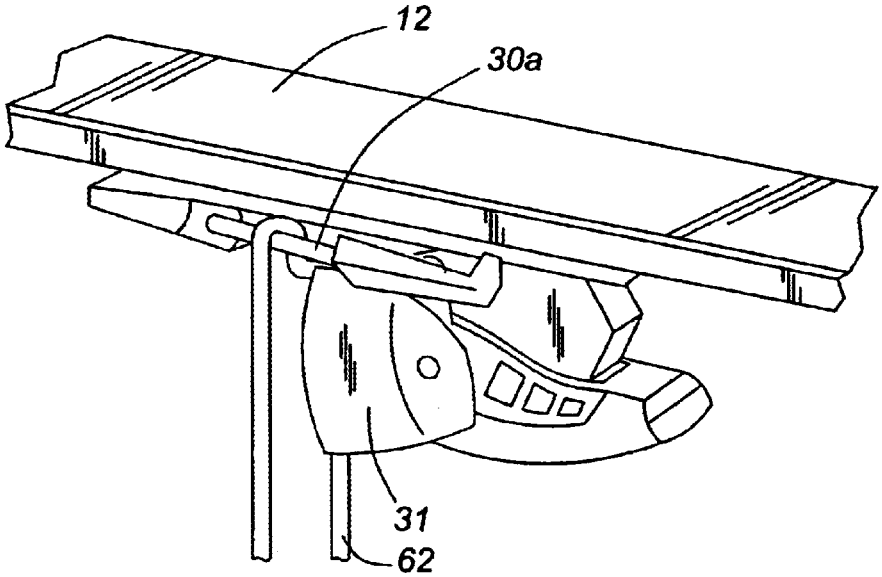
FIG. 5 is a further perspective view of the ski in a horizontal position with the accessory cord looped around the ski brake and held taunt thereby retracting said ski brake to facilitate ski base preparation.

Reference will now be had to FIG. 3 which shows the tensioning device 60 and all related components thereof. Essentially, said tensioning device 60 comprises a length of nylon accessory cord 62 fed through an aperture 64 towards the distal end of the upper leg of the C-clamp 20, with said nylon accessory cord being fed through a V-cleat 66 mounted vertically on one side of the C-clamp 20 by means of threaded fasteners 70. The accessory cord 62 is knotted at both ends to prevent detachment from C-clamp 20. A plastic co-extrusion 72 is snap-fit onto the underside of the upper leg of the C-clamp 20 to prevent damage to the work station surface during use and also provide for good frictional engagement therewith.

With reference to FIG. 1 the tensioning device 60 is fastened to the work bench intermediate the ski supports 10 and directly under the ski brake 30. With the apparatus fastened to the workbench the tensioning device 60 can be used to hold the ski firmly in one of two positions to be described hereinafter.

Figure 6:
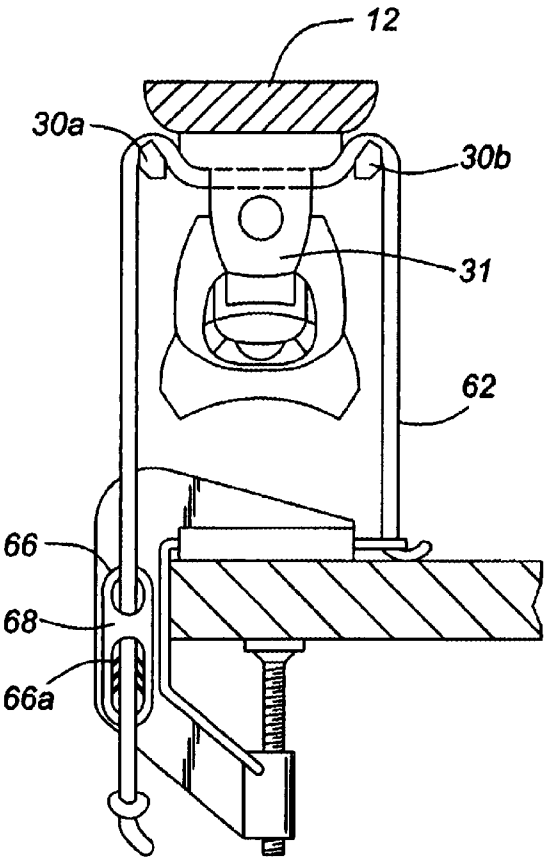
FIG. 6 is an elevation view, partly in section, of the ski positioned horizontally for base preparation with the accessory cord looped around both ski brake arms thereby retracting the ski brake.

As best seen in FIGS. 4–7, holding the ski firmly for ski base preparation and maintenance is best accomplished by looping the accessory cord 62 through both arms 30*a* and 30*b* of the ski brake 30 portion of the ski binding 31 and pulling said accessory cord 62 down to fully retract the ski brake, then biasing accessory cord 62 while held taunt into cleat teeth 66*a*, so that cleat 66 firmly grips and secures accessory cord 62 thereby holding the ski firmly to the ski supports 10 in a generally horizontal position under tension with the ski brake 30 retracted. As illustrated in FIG. 6, viewed in elevation with the ski secured horizontally in the apparatus, the accessory cord 62 has a configuration resembling the letter 'M'.

Figure 11:
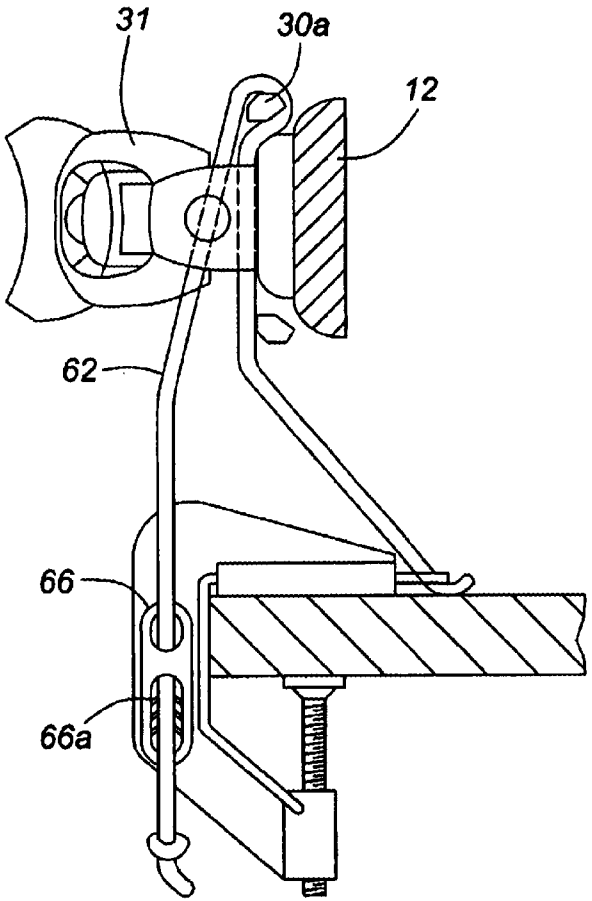
FIG. 11 is a view similar to that of FIG. 6 except that the ski is positioned "edge-up" to facilitate ski edge preparation and the accessory cord is looped around only the top ski brake arm thereby retracting the ski brake.

As best seen in FIGS. 9–12, holding the ski firmly for ski edge preparation and maintenance is best accomplished by looping the accessory cord 62 around the ski 12 and uppermost arm 30*a* of the ski brake 30 and pulling said accessory cord 62 down to fully retract the ski brake, then biasing accessory cord 62 while held taunt into cleat teeth 66*a*, so cleat 66 firmly grips and secures accessory cord 62 thereby rotating the ski somewhat counter-clockwise about its longitudinal axis and holding the ski against the upper vertical portion of the support head rubber pad 56 and the bottom inside wall of the side holder 18 (as illustrated by the two arrows in FIG. 12) thus holding the ski firmly in a generally edge-up position under tension with the ski brake 30 retracted. As illustrated in FIG. 11, viewed in elevation with the ski secured edge-up in the apparatus, the accessory cord 62 has a configuration resembling the letter 'C'.

Reference may also be had to FIGS. 2 and 8 which clearly illustrate the tensioning device holding the ski against the ski supports 10 as described above in a generally horizontal position to facilitate ski base preparation and in a generally edge-up position to facilitate ski side edge preparation, respectively.

The various ways in which the apparatus described above may be utilized will be readily apparent from the foregoing description and the accompanying drawings. Those skilled in this particular art will appreciate that the apparatus described above permits ski repair and maintenance work to be readily accomplished with, at the same time, a minimum of time and effort being required to mount and dismount the ski to and from the ski holder.

A preferred embodiment of the invention has been described by way of example. Those skilled in the art will realize that various modifications and changes may be made while remaining within the spirit and scope of the invention. Hence the invention is not to be limited to the embodiment as described but, rather, the invention encompasses the full range of equivalencies as defined by the appended claims.

What is claimed is:

1. Apparatus for holding skis at a work station comprising a pair of supports adapted to be used in spaced apart relation to support the opposing end portions of a ski, each support comprising a base section adapted to be fixed to the work station in a generally upright position and a ski support head mounted to said base section, said support head having a top surface for holding a ski base-up and in a generally horizontal position for ski base maintenance operations, and a tensioning device adapted to be attached to the work station intermediate the spaced pair of ski supports for engaging the ski and holding the latter against said spaced ski supports while at the same time holding a ski brake on the ski in a retracted position; said tensioning device including a length of cord capable of being brought around the ski brake for retracting the latter and holding the ski against said ski supports; said tensioning device also including a C-clamp adapted to be fixed to the work station and a cleat mounted on said clamp, said length of cord co-operating with said C-clamp and capable of engaging said cleat such that when said cord is tensioned and engaged with said cleat it provides means to pull and retract the ski brake thereby holding the ski under tension against the pair of ski supports.

* * * * *